US007817103B2

(12) United States Patent
Kersten et al.

(10) Patent No.: US 7,817,103 B2
(45) Date of Patent: Oct. 19, 2010

(54) DUAL-BAND MULTI-PITCH PARASITIC HALF-WAVE (MPPH) ANTENNA

(75) Inventors: Stephen L. Kersten, Coral Springs, FL (US); Ovadia Grossman, Tel Aviv (IL); Sooliam Ooi, Plantation, FL (US)

(73) Assignee: Motorola, Inc., Schaumburg, IL (US)

( * ) Notice: Subject to any disclaimer, the term of this patent is extended or adjusted under 35 U.S.C. 154(b) by 288 days.

(21) Appl. No.: 12/039,369

(22) Filed: Feb. 28, 2008

(65) Prior Publication Data

US 2009/0219220 A1 Sep. 3, 2009

(51) Int. Cl.
*H01Q 1/36* (2006.01)

(52) U.S. Cl. ..... 343/895

(58) Field of Classification Search ..... 343/711–713, 343/700 MS, 702, 895
See application file for complete search history.

(56) References Cited

U.S. PATENT DOCUMENTS

| | | | | |
|---|---|---|---|---|
| 5,923,305 | A * | 7/1999 | Sadler et al. | 343/895 |
| 6,107,972 | A * | 8/2000 | Seward et al. | 343/722 |
| 6,297,711 | B1 | 10/2001 | Seward et al. | |
| 6,329,962 | B2 * | 12/2001 | Ying | 343/895 |
| 2006/0250319 | A1 | 11/2006 | Ooi et al. | |
| 2008/0174501 | A1 * | 7/2008 | Licul et al. | 343/703 |

FOREIGN PATENT DOCUMENTS

| | | | |
|---|---|---|---|
| EP | 1291967 A | | 3/2003 |
| GB | 2400497 A | | 10/2004 |
| JP | 2001 024424 A | * | 1/2001 |
| JP | 2001024424 A | | 1/2001 |
| JP | 2001223518 A | | 8/2001 |
| JP | 2003037426 A | | 2/2003 |

OTHER PUBLICATIONS

PCT/US2009/035202—European Search Report-Written Opinion, mailed Jul. 3 2009—17 pages.
Sooliam Ooi—"Wideband Monopole Antenna for Public Safety Radio"—Antennas and Propagation Society Int'l Symposium—IEEE, vol. 2A, Jul. 2005—pp. 363-366.
Hisamatsu Nakano et al—"Realization of Dual-Frequency and Wide-Band VSWR Performances Using Normal-Mode Helical and Inverted-F Antennas"—IEEE Transaction, vol. 46, Issue 6—Jun. 1998—pp. 788-793.

* cited by examiner

*Primary Examiner*—Huedung Mancuso
(74) *Attorney, Agent, or Firm*—Barbara R. Doutre

(57) ABSTRACT

A dual band multi-pitch helical antenna (101) includes a first section (201) positioned adjacent to the feed point having a widely spaced pitch. A second section (203) is attached to the first section (201) having a narrowly spaced pitch. A third section (205) is attached to the second section (203) having a widely spaced pitch, while a fourth section (207) is attached to the third section (205) having a narrowly spaced pitch. The antenna further includes a parasitic element (213*a*/213*b*) that is positioned adjacent to each of the first section (201), second section (203), third section (205), and fourth section (207) for enhancing broad-band antenna performance. A matching network (216) is connected between an antenna feed point and the first section (201) for matching the dual band multi-pitch helical antenna to a predetermined feed point impedance such that the antenna is resonant in at least two frequency bands.

20 Claims, 4 Drawing Sheets

DUAL-BAND MULTI-PITCH PARASITIC HALF-WAVE (MPPH) ANTENNA

FIELD OF THE INVENTION

The present invention relates to helically wound portable antennas and more particularly to a dual-band multi-pitch helical antenna with integrated half-wave radiator that may be used in the very high frequency (VHF) and 800 MHz frequency spectrum.

BACKGROUND

Helically wound antennas have been used for many years on portable, handheld two-way radio equipment offering a convenient and moderately effective radiator. Since the antenna is wound shorter in size, depending on the frequency of use, it may lose some overall efficiency as compared with a full size antenna. However, what is lost in efficiency is gained in convenience in that the antenna is often very small and versatile in view of its flexible outer sheath making it difficult to bend or break.

The conventional Association of Public Safety Officials (APCO) type public safety radios provide services in both VHF (136-174 MHz) and 800 MHz (760-870 MHz) frequency bands. The challenges in designing a VHF/800 antenna are in obtaining the proper resonances for each band simultaneously in the same antenna structure. Additionally, the broadside radiation pattern of the 800 band for a nominal dual band antenna covering these bands has the tendency to be downward pointing which is detrimental to the performance in achieving optimal signal transmission and reception. This is due to the close proximity of the transmitting radio's chassis currents to the radiating antenna elements. Finally, the dependency of the radio housing or chassis for radiation in the 800 MHz band also limits an antenna's radiation performance.

BRIEF DESCRIPTION OF THE FIGURES

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

Figure 1:
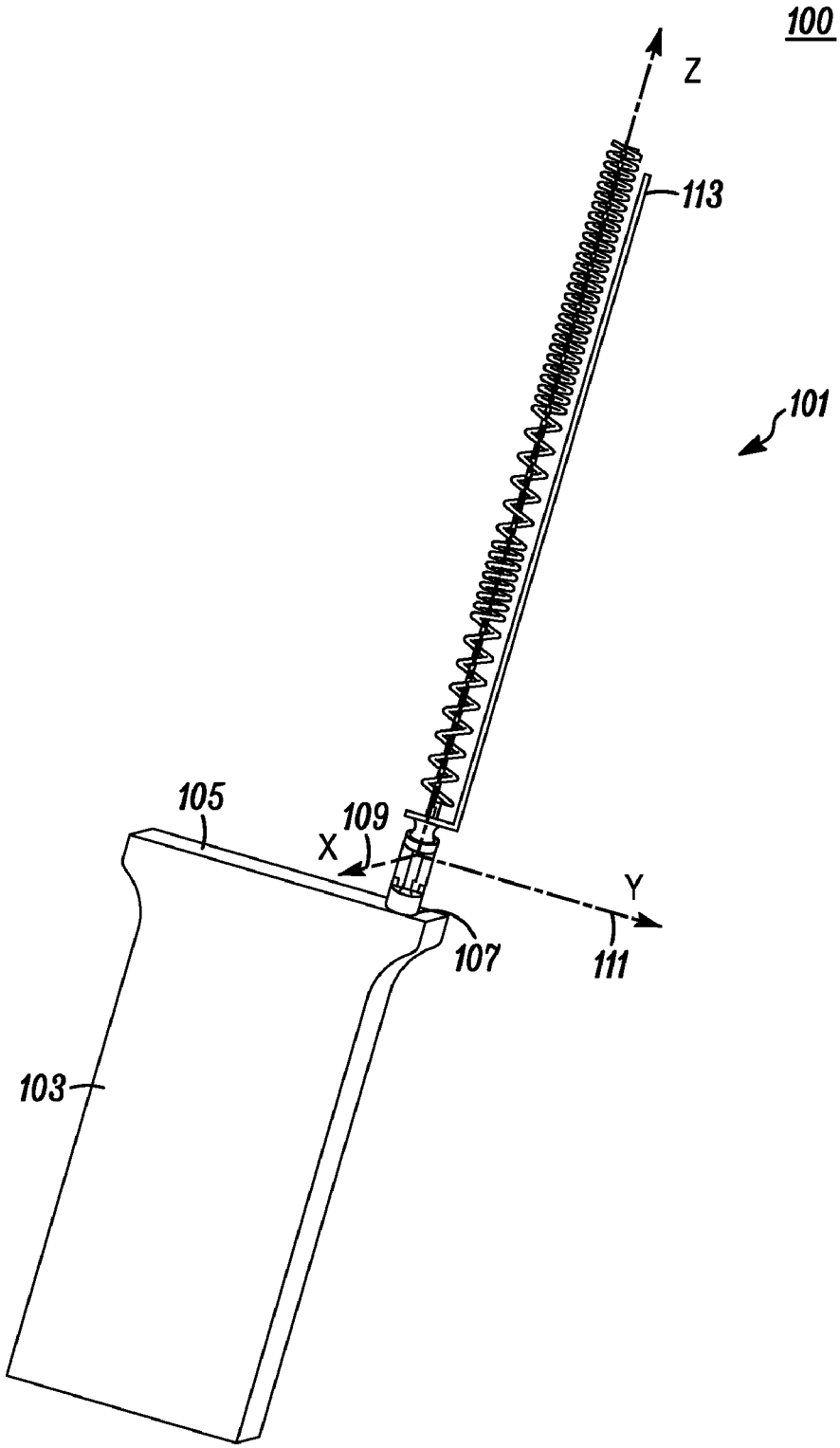
FIG. 1 is perspective view of the MPPH antenna in accordance with an embodiment of the invention.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION

Before describing in detail embodiments that are in accordance with the present invention, it should be observed that the embodiments reside primarily in combinations of method steps and apparatus components related to a complementary cumulative distribution driven level convergence system and method. Accordingly, the apparatus components and method steps have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

In this document, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises . . . a" does not, without more constraints, preclude the existence of additional identical elements in the process, method, article, or apparatus that comprises the element.

FIG. 1 is perspective view of the MPPH antenna 100 in accordance with an embodiment of the invention Typically, the antenna 101 is mounted to a radio housing 103 which has upper surface or top 105. The antenna typically might be mounted along an edge surface 107 such that it is spatially oriented in relation to the upper surface 105 having dimensions X 109, Y 111, and Z 113.

Figure 2:
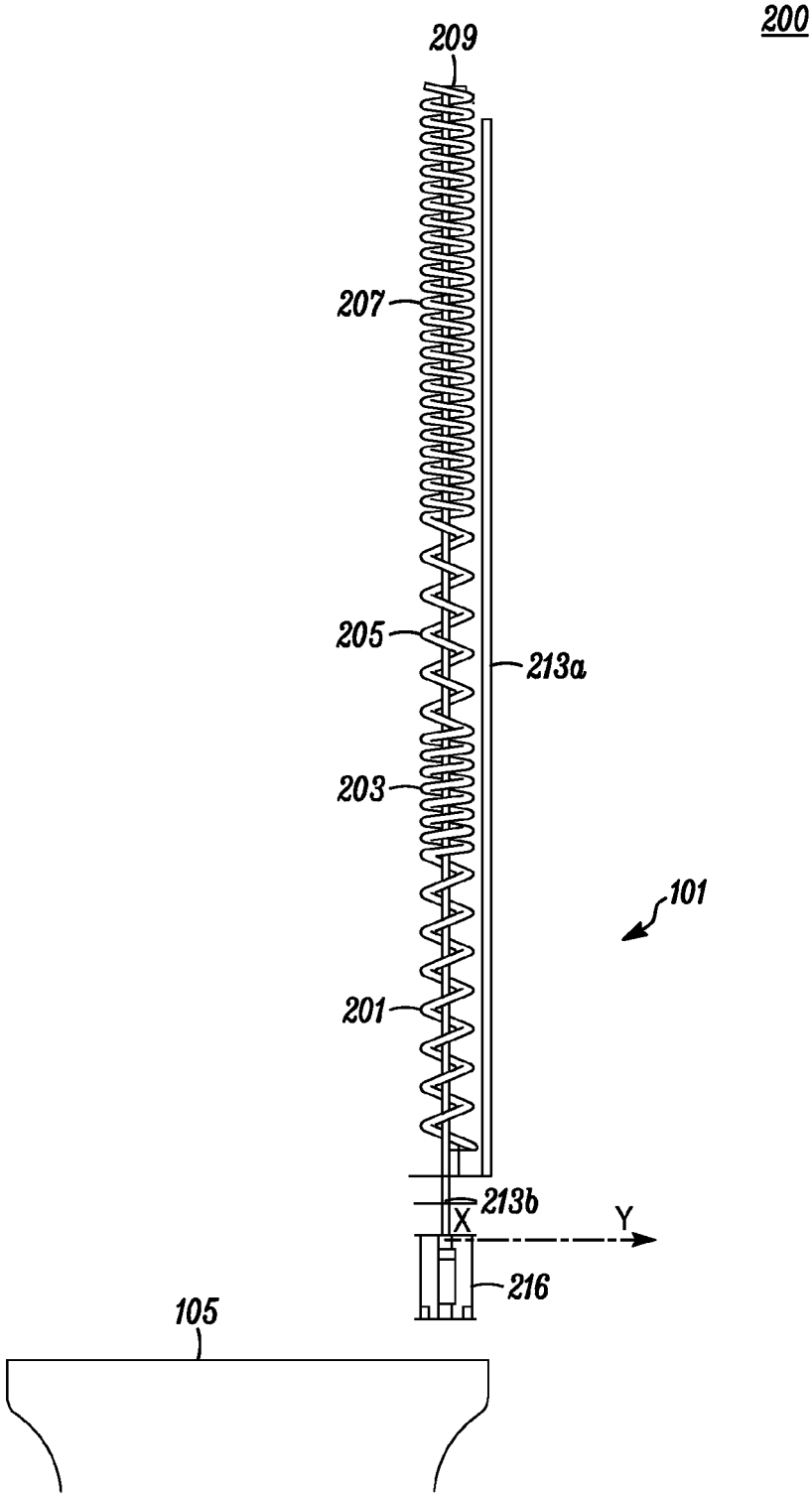
FIG. 2 is a magnified view of the MPPH antenna shown in FIG. 1.

FIG. 2 is a magnified view 200 of the MPPH antenna shown in FIG. 1. The antenna 101 is comprised of a first section 201 having a wide-spaced pitch for operating as a base helix providing a higher band resonance and matching that typically might be in the 800 MHz spectrum. As will be recognized by those skilled in the art, the term "pitch" refers to the distance between turns in helical coil forming section 201 and each subsequent section as described herein. The second section 203 is a narrow-pitch helix and is designed to produce an electrical one-quarter wavelength at a higher radio frequency (RF) frequency band to provide sufficient electrical choking for preventing RF energy from entering the outer portions of the antenna. Thus, the second section 203 provides isolation between the resonances of the two bands, e.g., VHF and 800 MHz. A third section 205 is a wide pitch section and provides discontinuity to the RF antenna current distribution. This occurs by creating the abrupt change in helix pitch where the third section 205 electrical length is an additional one-quarter wave length. A fourth section 207 is also a narrow pitch section which sums or totals up the electrical wave length of the helix 101 to provide resonance in the VHF band. The antenna may include a top or cap that may be frictionally engaged to an end 209. Finally, a parasitic element 213*a*/213*b* is electrically coupled to the first section 201, second section 203, third section 205, and fourth section 207 which positioning is a predetermined distance from these elements. The parasitic element 213*a*/213*b* is linear in nature extending substantially the length of the four helical sections which form the MPPH antenna 101. Parasitic element 213*a* is positioned outside the four helical sections, while in an alternative embodiment parasitic element 213*b* is positioned inside the four helical sections.

In order to properly match the antenna to the radio's 50 ohm antenna termination impedance, a matching section 216 is used between the first section 101 and radio connector (not shown) mechanically mounted to the top 105 of the radio housing. The matching circuit is positioned a distance "X" below the stub meeting the first section 201 and provides broad band matching to the antenna at its various operating frequencies. The matching circuit may typically be comprised of a inductive-capacitive (LC) matching section (not shown) in order to cancel various electrical reactance which results from antenna mismatch. In that the MPPH antenna 101 of the present invention utilizes an end-fed half wavelength parasitic element as described herein, this may result in high inductive and/or capacitive reactive components at the feed point requiring use of the matching section 216.

In operation, both the pitch of the helix in each of the four sections as well as its length may be adjusted to obtain the correct resonant frequency. The parasitic element 213*a*/213*b* is placed in close proximity to each of the MPPH helical elements which also will affect resonance. The length of the parasitic element 213*a*/213*b* is sized to one-half of a wave length at the lowest operating frequency such that it is substantially the same size as the combined length of the first section 201, second section 203, third section 205 and fourth section 207. As seen in FIG. 2, the parasitic element 213*a* and parasitic element 213*b* may also be placed on either the outside or inside of the first section 201, second section 203, third section 205, or fourth section 207. With regard to parasitic element 213*a*, it is positioned a distance "Y" from center of the sections forming the helix. The parasitic element 213*a*/213*b* may also be molded inside a sheath (not shown) or mechanically fastened onto the sheath using a conductive tape, glue, or non-conductive hardware. Moreover, a plastic, rubber, or other material may be used to protectively cover the antenna making it in the form of a durable "rubber ducky" type of antenna used with portable two-way radio transceivers. The parasitic element 213*a*/213*b* can also be realized in the form of a helix with the appropriate electrical length, wrapping around the first section 201, second section 203, third section 205, and fourth section 207. The lengths of the parasitic element 213 and the number of turns of the fourth section of the helix 207 are to be altered to tune the resonant frequencies of the MPPH antenna 101 to the desired frequencies in both bands.

Figure 3:
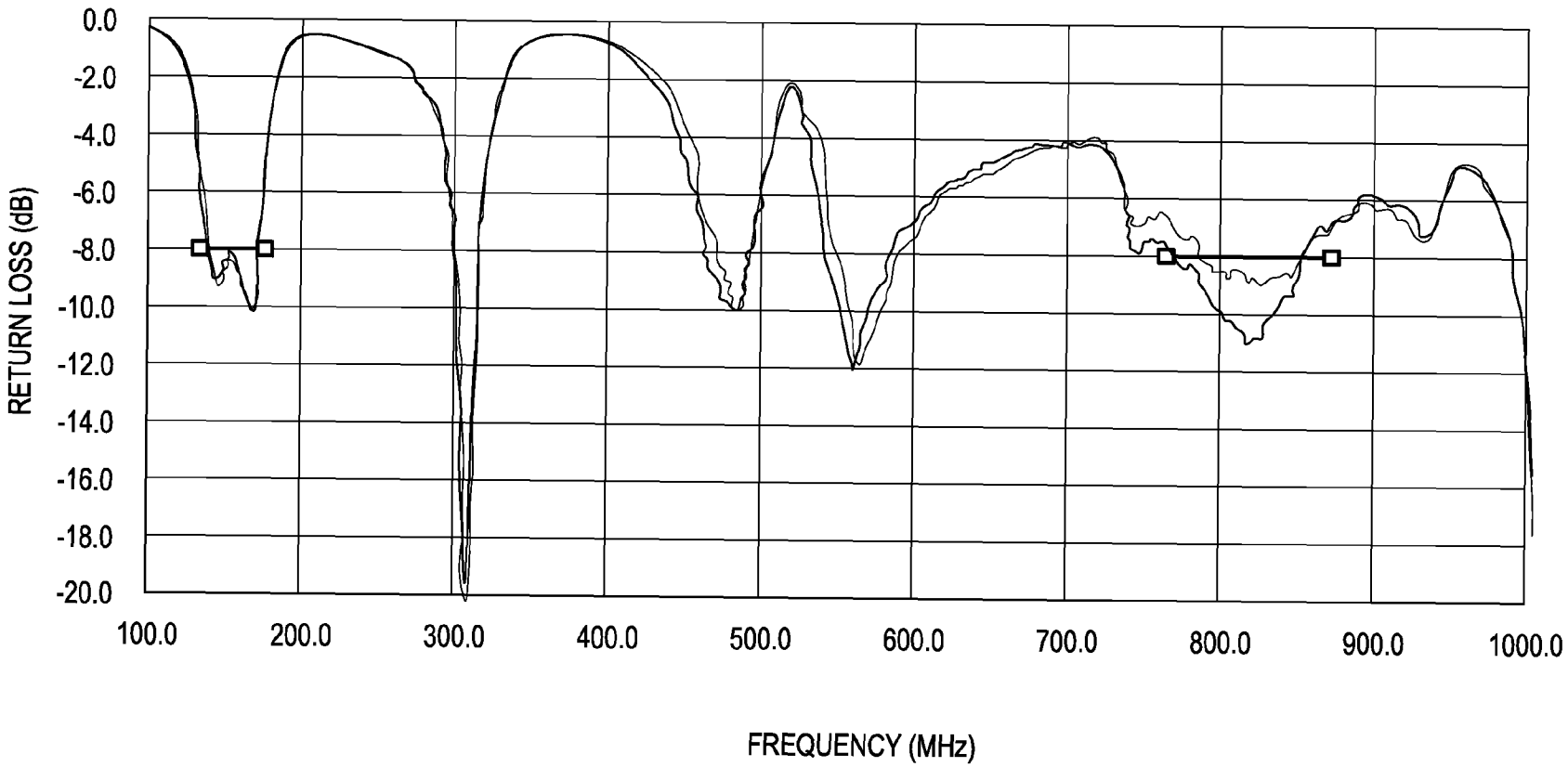
FIG. 3 is graphical diagram return loss versus frequency of the MPPH antenna as shown in FIG. 1.

FIG. 3 is graphical diagram return loss versus frequency of the MPPH antenna as shown in FIG. 1. The range of loss used in this example is between 1 dB and −20 dB over frequency spectrum between 100 MHz to 1 GHz. As seen in the graphical representation, the radiation pattern illustrates a comparison of 800 MHz band antennas mounted on a typical portable radio chassis. These antennas include the antenna QW which is the radiation pattern of a quarter wave antenna, showing downward radiation pattern, antenna P1 which is the radiation pattern of a multi pitch helix without the parasitic radiator that shows a similar downward radiation to that of QW. The antenna HW is the radiation pattern of a half wave whip antenna which has a typical half wave radiation pattern. Finally, antenna MPPH is the radiation pattern of the MPPH antenna described in an embodiment of the present invention which shows a radiation pattern covering a majority of directions in the horizontal plane and upward.

TABLE 1

| Antenna | Description | Pattern | Freespace Eff (%) | Handheld Eff (%) |
|---|---|---|---|---|
| P1 | Mackinaw P1 antenna | Downward | 62 | 41.38 |
| QW | Short quarter wave monopole antenna | Downward | 65.2 | 46 |
| HW | Standard half wave whip antenna | Half wave Dipole | 59 | 56.73 |
| MPPH | Multi pitch helix with Parasitic Half wave radiator | Upward | 67.8 | 55.53 |

Table 1 above shows the measured radiation efficiencies of the antennas in both free space and hand-held positions where radiation efficiency is defined as the ratio of the total power radiated by the antenna to the net power accepted by the antenna by a connected transmitter. This data illustrates the efficiency of the MPPH antenna that is consistently comparable to that of a single band half wavelength whip-type antenna.

Figure 4:
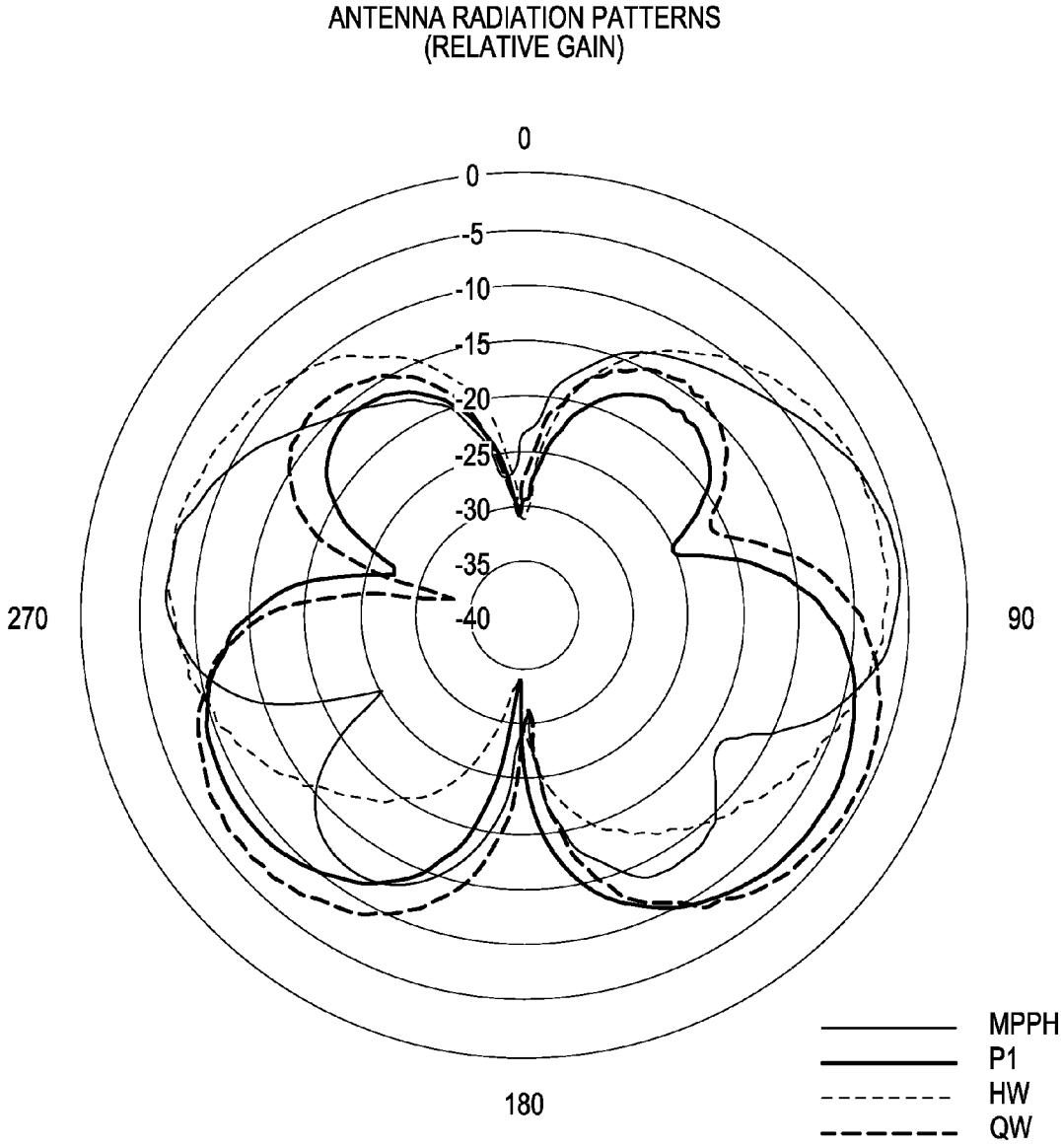
FIG. 4 is a polar plot diagram showing the antenna radiation pattern of the MPPH antenna as shown in FIG. 1 as compared with other types of antennas.

FIG. 4 is a polar plot diagram showing the antenna radiation pattern of the MPPH antenna as shown in FIG. 1 as compared with other types of antennas shown in Table 1 above. In the plot shown in FIG. 4, the MPPH antenna uses a concentric parasitic element 213*b* placed inside the sections of the multi-pitch helix. As seen in the plot, resonances in both the VHF and 800 MHz bands are present in the MPPH antenna which illustrates the utility for an integration between a quarter-wave-based helix and a parasitic half-wave radiator in a VHF/800 MHz helical antenna. Thus, this type of helical antenna is designed with the base helical antenna section such that it provides a wide band matched impendence at the frequency bands of interest namely between 100-200 MHz and 800 MHz.

Thus, the present invention is a dual band multi-pitch parasitic half-wave antenna which utilizes an additional section of the helix that by manipulating the pitch and the number of turns provides the appropriate isolation of the base section from the remainder of the helix. The subsequent sections of the antenna total up its electrical length of the whole antenna to provide resonance and antenna functionality for the VHF band. A broad-banding matching circuit is used at the base of the antenna to broaden the matched bandwidth of the antenna, if necessary.

In the foregoing specification, specific embodiments of the present invention have been described. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

We claim:

1. A dual band multi-pitch helical antenna for a portable handheld radio comprising:

a first section positioned adjacent an antenna feed point of the portable handheld radio having a widely spaced pitch;

a second section attached to the first section having a narrowly spaced pitch;

a third section attached to the second section having a widely spaced pitch;

a fourth section attached to the third section having a narrowly spaced pitch;

at least one parasitic element positioned adjacent to each of the first section, the second section, the third section, and the fourth section;

a matching network connected between the antenna feed point of the portable handheld radio and the first section for matching the dual band multi-pitch helical antenna to a predetermined feed point impedance; and wherein the antenna is resonant in at least two frequency bands, and further wherein the antenna generates a radiation pattern covering a majority of directions in a horizontal plane of the antenna and upward from the portable handheld radio.

2. A dual band multi-pitch helical antenna as in claim 1, wherein the first section and the third section are substantially similar in length.

3. A dual band multi-pitch helical antenna as in claim 1, wherein the second section is shorter than the fourth section.

4. A dual band multi-pitch helical antenna as in claim 1, wherein the frequency bands are a very high frequency (VHF) frequency band and an 800 MHz frequency band.

5. A dual band multi-pitch helical antenna as in claim 1, wherein the antenna is also resonant in a global positioning system (GPS) frequency band.

6. A dual band multi-pitch helical antenna as in claim 1, wherein the at least one parasitic element is positioned outside the first section, the second section, the third section, and the fourth section.

7. A dual band multi-pitch helical antenna as in claim 1, wherein the at least one parasitic element is positioned inside the first section, the second section, the third section, and the fourth section.

8. A multi-pitch helically wound antenna for use with a portable, two-way, handheld radio transceiver comprising:

a first section having a substantially wide spaced pitch;

a second section having a substantially narrow spaced pitch connect to the first section for acting as a radio frequency (RF) choke for preventing RF energy from passing past the second section;

a third section having a wide spaced pitch connecting with the second section;

a fourth section having a narrow spaced pitch connecting with the third section and forming a distal end of the antenna;

at least one parasitic element positioned adjacent to the first section, the second section, the third section, and the fourth section;

a matching network connected with the first section for tuning out reactive components at an antenna feed point of the portable, two-way, handheld radio transceiver; and wherein the antenna is substantially matched to the portable, two-way, handheld radio for use in the very high frequency (VHF), 800 MHz, and global positioning system (GPS) frequency bands, further wherein the antenna generates a radiation pattern covering a majority of directions in a horizontal plane of the antenna and upward from the portable, two-way, handheld radio.

9. A multi-pitch helically wound antenna as in claim 8, wherein the first section and the third section have substantially the same pitch.

10. A multi-pitch helically wound antenna as in claim 8, wherein the second section and the fourth section have substantially the same pitch.

11. A multi-pitch helically wound antenna as in claim 8, wherein the at least one parasitic element is positioned outside the first section, the second section, the third section, and the fourth section.

12. A multi-pitch helically wound antenna as in claim 8, wherein the at least one parasitic element is positioned outside the first section, the second section, the third section, and the fourth section.

13. A multi-pitch helically wound antenna as in claim 8, wherein the at least one parasitic element is substantially as long as a combined length of the first section, the second section, the third section, and the fourth section.

14. A method for resonating a dual band multi-pitch helical antenna for a portable handheld radio comprising the steps of:

positioning a first section having a widely spaced pitch adjacent to an antenna feed point of the portable handheld radio;

positioning a second section having a narrowly spaced pitch attached to the first section;

positioning a third section having a widely spaced pitch attached to the second section;

positioning a fourth section having a narrowly spaced pitch attached to the third section;

positioning at least one parasitic element adjacent to each of the first section, the second section, the third section, and the fourth section;

connecting a matching network between the antenna feed point of the portable, handheld radio and the first section for matching the antenna to a predetermined feed point impedance; and adjusting the widely spaced pitch and narrow spaced pitch so that the antenna is resonant in at least two frequency bands, wherein the antenna generates a radiation pattern covering a majority of directions in a horizontal plane of the antenna and upward from the portable, handheld radio.

15. A method for resonating a dual band multi-pitch helical antenna as in claim 14, further comprising the step of:

adjusting the pitch of the first section and the third section such that they are substantially similar in length.

16. A method for resonating a dual band multi-pitch helical antenna as in claim 14, further comprising the step of:

adjusting a length of the second section such that it is shorter in length than the fourth section.

17. A method for resonating a dual band multi-pitch helical antenna as in claim 14, further comprising the step of:

adjusting the narrow spaced pitch and the wide spaced pitch such that the antenna is resonant in a very high frequency (VHF) frequency band and a 800 MHz frequency band.

18. A method for resonating a dual band multi-pitch helical antenna as in claim 14, further comprising the step of:

adjusting the narrow spaced pitch and the wide spaced pitch so that the antenna is also resonant in a global positioning system (GPS) frequency band.

19. A method for resonating a dual band multi-pitch helical antenna as in claim 14, further including the step of:

positioning the at least one parasitic element outside the first section, the second section, the third section, and the fourth section.

20. A method for resonating a dual band multi-pitch helical antenna as in claim 14, further including the step of:

positioning the at least one parasitic element inside the first section, the second section, the third section, and the fourth section.

* * * * *

UNITED STATES PATENT AND TRADEMARK OFFICE

CERTIFICATE OF CORRECTION

PATENT NO. : 7,817,103 B2
APPLICATION NO. : 12/039369
DATED : October 19, 2010
INVENTOR(S) : Kersten et al.

It is certified that error appears in the above-identified patent and that said Letters Patent is hereby corrected as shown below:

Title Pg, Item (56), under "FOREIGN PATENT DOCUMENTS", in Column 2, Line 3, delete "JP 2001024424 A 1/2001".

Title Pg, Item (56), under "OTHER PUBLICATIONS", in Column 2, Line 2, delete "Jul. 3" and insert -- Jul. 13 --, therefor.

Signed and Sealed this
Eighth Day of November, 2011

David J. Kappos

David J. Kappos
*Director of the United States Patent and Trademark Office*